US008412056B2

(12) United States Patent
Furuichi et al.

(10) Patent No.: US 8,412,056 B2
(45) Date of Patent: Apr. 2, 2013

(54) IMAGE FORMING APPARATUS PERFORMING IMAGE FORMATION BY CONVEYING PAPER

(75) Inventors: Yuusuke Furuichi, Osaka (JP); Nobuhiko Kita, Osaka (JP); Sei Onuma, Osaka (JP); Tatsuo Fukushima, Osaka (JP); Haruo Hashimoto, Osaka (JP); Genta Hagiwara, Osaka (JP); Masafumi Takahira, Osaka (JP); Kaoru Tada, Osaka (JP)

(73) Assignee: Ricoh Company Limited, Tokyo (JP)

( * ) Notice: Subject to any disclaimer, the term of this patent is extended or adjusted under 35 U.S.C. 154(b) by 350 days.

(21) Appl. No.: 12/923,061

(22) Filed: Aug. 31, 2010

(65) Prior Publication Data

US 2011/0058847 A1 Mar. 10, 2011

(30) Foreign Application Priority Data

Sep. 4, 2009 (JP) ..... 2009-205104

(51) Int. Cl.
*G03G 15/00* (2006.01)

(52) U.S. Cl. ..... 399/21; 399/110; 399/124

(58) Field of Classification Search ..... 399/21, 399/110, 124
See application file for complete search history.

(56) References Cited

U.S. PATENT DOCUMENTS

| | | | | |
|---|---|---|---|---|
| 6,775,486 | B2 * | 8/2004 | Matsuyama et al. | 399/21 |
| 7,555,244 | B2 | 6/2009 | Idehara et al. | |
| 7,580,653 | B2 | 8/2009 | Idehara et al. | |
| 7,611,106 | B2 | 11/2009 | Kondo et al. | |
| 7,676,176 | B2 | 3/2010 | Fujiwara et al. | |
| 7,677,555 | B2 | 3/2010 | Tanaka et al. | |
| 7,689,142 | B2 | 3/2010 | Kita et al. | |
| 2007/0065201 | A1 | 3/2007 | Fujiwara et al. | |
| 2007/0110473 | A1 | 5/2007 | Kondo et al. | |
| 2007/0110475 | A1 | 5/2007 | Idehara et al. | |
| 2007/0166073 | A1 | 7/2007 | Idehara et al. | |
| 2007/0246638 | A1 | 10/2007 | Idehara et al. | |
| 2008/0006166 | A1 | 1/2008 | Ohkubo et al. | |
| 2008/0007935 | A1 | 1/2008 | Kondo et al. | |
| 2008/0050146 | A1 | 2/2008 | Kita et al. | |
| 2008/0063425 | A1 | 3/2008 | Idehara et al. | |
| 2008/0075502 | A1 | 3/2008 | Tada et al. | |
| 2008/0226352 | A1 | 9/2008 | Tanaka et al. | |
| 2008/0226358 | A1 | 9/2008 | Hanashima et al. | |
| 2008/0253796 | A1 | 10/2008 | Idehara et al. | |
| 2008/0279585 | A1 | 11/2008 | Furuichi et al. | |
| 2008/0292356 | A1 | 11/2008 | Furuichi et al. | |
| 2009/0022514 | A1 | 1/2009 | Fujiwara et al. | |
| 2009/0056484 | A1 | 3/2009 | Hanashima et al. | |
| 2009/0074446 | A1 | 3/2009 | Idehara et al. | |

(Continued)

FOREIGN PATENT DOCUMENTS

| | | | |
|---|---|---|---|
| JP | 2003-72978 | | 3/2003 |
| JP | 2006243109 | A * | 9/2006 |

*Primary Examiner* — David Gray
*Assistant Examiner* — Laura Roth
(74) *Attorney, Agent, or Firm* — Harness, Dickey & Pierce, P.L.C.

(57) ABSTRACT

An image forming apparatus includes a transfer belt that conveys a transfer material, and a photosensitive body that catches the transfer material between the photosensitive body and the transfer belt and that transfers a toner image to the transfer material. The transfer belt is driven in conjunction with the opening action of the front cover, and the photosensitive body is separated from the transfer belt in conjunction with the opening action of the front cover.

12 Claims, 12 Drawing Sheets

U.S. PATENT DOCUMENTS

2009/0074456 A1 3/2009 Tada et al.
2009/0080937 A1 3/2009 Kita et al.
2009/0092412 A1* 4/2009 Kei ..... 399/110
2009/0110432 A1 4/2009 Idehara et al.
2009/0121418 A1 5/2009 Tanaka et al.
2009/0152435 A1 6/2009 Kondo et al.
2009/0174135 A1 7/2009 Tanaka et al.
2009/0285588 A1 11/2009 Furuichi et al.
2009/0302521 A1 12/2009 Kondo et al.
2009/0315250 A1 12/2009 Kimura et al.
2010/0061755 A1 3/2010 Furuichi et al.
2010/0067942 A1 3/2010 Hagiwara et al.
2010/0189474 A1* 7/2010 Nishiuwatoko
2010/0247138 A1* 9/2010 Kikuchi et al. ..... 399/110

* cited by examiner

IMAGE FORMING APPARATUS PERFORMING IMAGE FORMATION BY CONVEYING PAPER

CROSS-REFERENCE TO RELATED APPLICATIONS

The present application claims priority to and incorporates by reference the entire contents of Japanese Patent Application No. 2009-205104 filed in Japan on Sep. 4, 2009.

BACKGROUND OF THE INVENTION

1. Field of the Invention

The present invention relates to an image forming apparatus that performs image formation by conveying paper.

2. Description of the Related Art

In an image forming apparatus, paper taken out from a paper feed tray is conveyed by a conveying unit and thus moves inside of the image forming apparatus to pass through an image forming unit, a fixing unit, and other units. Thus, image formation is performed on the surface of the paper. Because of this structure, paper may be jammed in the middle of the conveying path through which the paper is conveyed to the image forming unit and the fixing unit. In other words, a paper jam (jam) may occur.

Typically, for removing this paper jam, paper jammed in the middle of the conveying path is removed by opening the outer cover. However, paper may be jammed in the position where the paper cannot be immediately removed. Conveying rollers including knobs are provided to deal with such a situation. The conveying rollers are rotated with the knobs and move the paper to the position where the paper can be removed, where the paper is eventually removed.

For saving time and effort of rotating the conveying rollers with the knobs, for example, Japanese Patent Application Laid-open No. 2003-72978 discloses a method of enabling a conveying roller to be driven in conjunction with the closing and opening of an outer cover. In this method, when a jam occurs, the jam is removed by opening the outer cover and pulling out paper moved to a position where the paper can be removed by the conveying rollers driven in conjunction with the opening action of the outer cover.

Although paper moves to the position where the paper can be removed by the method disclosed in Japanese Patent Application Laid-open No. 2003-72978, users have to apply strong force to pull out the paper because the paper is nipped between the conveying rollers. Therefore, the method has such disadvantages that paper may be torn while being pulled out.

SUMMARY OF THE INVENTION

It is an object of the present invention to at least partially solve the problems in the conventional technology.

According to one aspect of the present invention, an image forming apparatus includes a transfer belt that conveys a transfer material, and a photosensitive body that catches the transfer material between the photosensitive body and the transfer belt and that transfers a toner image to the transfer material. The transfer belt is driven in conjunction with an opening action of a front cover, and the photosensitive body is separated from the transfer belt in conjunction with the opening action of the front cover.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are described below in greater detail with reference to the accompanying drawings.

Figure 1:
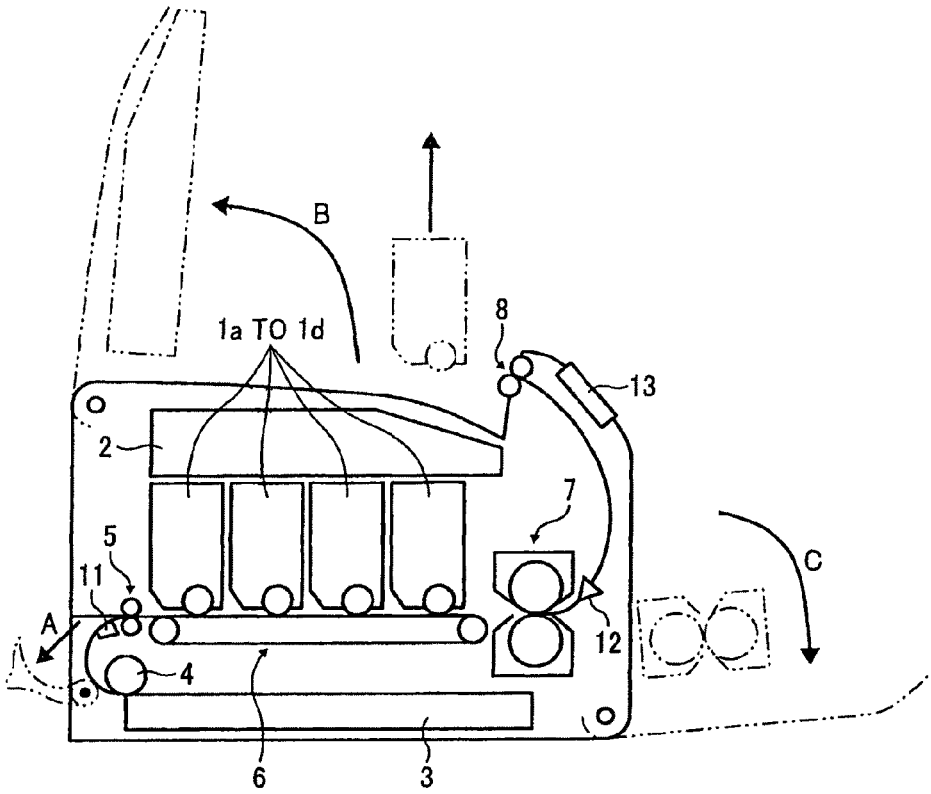
FIG. 1 is a cross-sectional schematic diagram of an image forming apparatus according to an embodiment of the present invention.

FIG. 1 is a cross-sectional schematic diagram of an image forming apparatus according to an embodiment of the present invention. The example illustrated in FIG. 1 is a full-color image forming apparatus employing a typical electrostatic image formation system, and the present invention is not limited to the image forming apparatus illustrated in FIG. 1.

As illustrated in FIG. 1, the image forming apparatus according to the embodiment of the present invention includes developing units 1*a* to 1*d*, a writing unit 2, a feed cassette 3, a feeding roller 4, a resist roller 5, a transfer unit 6, a fixing unit 7, and a discharging roller 8. The image forming apparatus forms images in full color according to typical electrophotographic process.

A transfer material conveying guide that is provided at a position between the feeding roller 4 and the resist roller 5 and that faces an image surface is integrally included in a rear cover and is openable and closable in an arrow A direction around a fulcrum. Therefore, a paper jam (jam) caused between the feeding roller 4 and the resist roller 5 can be removed. In other words, a transfer material jammed between the feeding roller 4 and the resist roller 5 can be removed by opening the transfer material conveying guide.

The writing unit 2 is openable in an arrow B direction together with a top cover. The developing units 1*a* to 1*d* can be taken out in an upward direction. Therefore, a jam caused between the resist roller 5 and the fixing unit 7 can be removed. In other words, a transfer material jammed between the resist roller 5 and the fixing unit 7 can be removed by opening the top cover and taking out the developing units 1*a* to 1*d* in an upward direction.

The fixing unit 7 is openable in an arrow C direction together with a front cover. Therefore, a jam caused near the fixing unit can be removed by opening this front cover.

A transfer material presence or absence detecting sensor 11 before a resist and a transfer material presence or absence detecting sensor 12 after fixing are provided on a conveying path for the transfer material and detect the presence or absence of paper on the sensors. As illustrated in FIG. 1, the transfer material presence or absence detecting sensor 11 before a resist is positioned at the front of the resist roller 5 and detects the presence or absence of the transfer material to be inserted into the resist roller 5. As illustrated in FIG. 1, the transfer material presence or absence detecting sensor 12 after fixing is positioned at the rear of the fixing unit 7 and detects the presence or absence of the transfer material coming out from the fixing unit 7.

Figure 2:
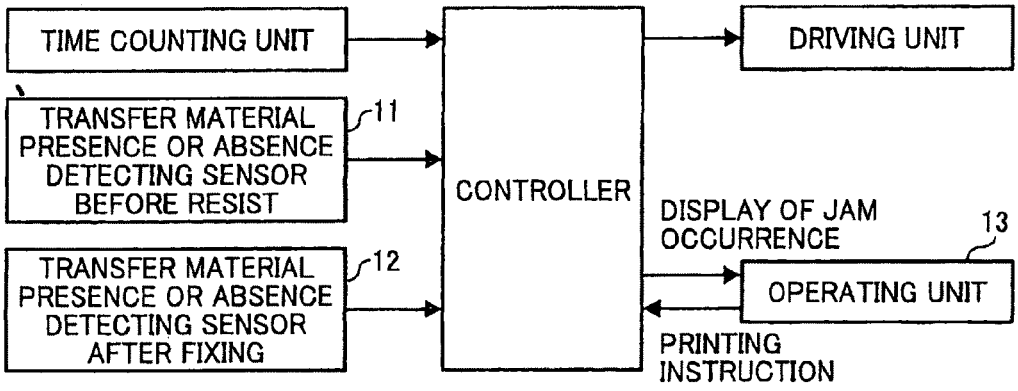
FIG. 2 is a block diagram of a structure of a controller of the image forming apparatus according to an embodiment of the present invention.

As illustrated in FIG. 2, a controller is connected with the transfer material presence or absence detecting sensor 11 before a resist and the transfer material presence or absence detecting sensor 12 after fixing. The controller is also connected with a time counting unit that counts time. Moreover, the controller is connected with an operating unit 13 including a displaying unit that displays information input from the controller and an input unit that receives operation information input by users. The controller receives a printing instruction or similar instructions input through the input unit. When a jam occurs, the controller displays messages notifying the occurrence of the jam on the displaying unit of the operating unit.

Figure 3:
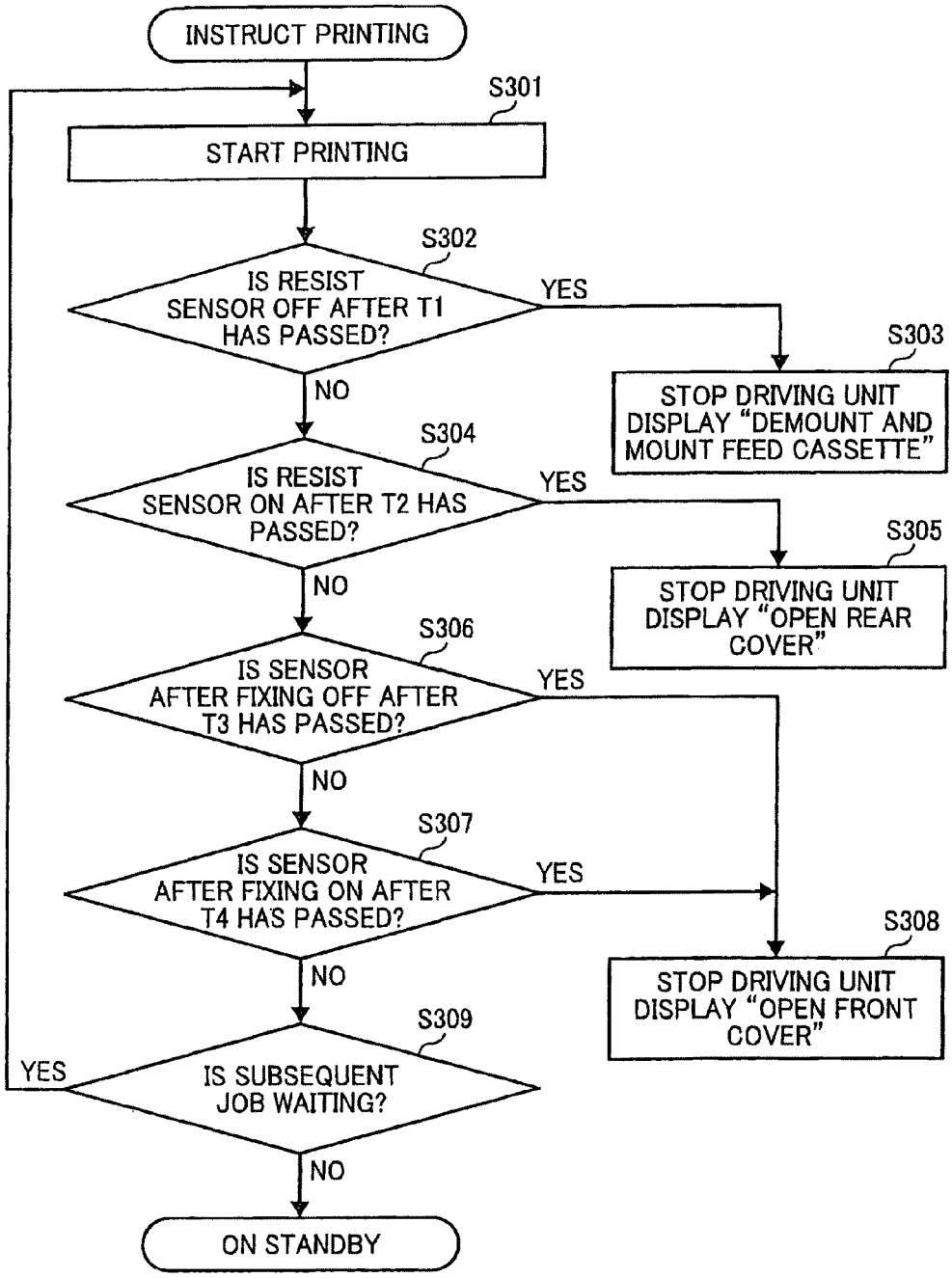
FIG. 3 is a flowchart of a process operation performed by the image forming apparatus according to an embodiment of the present invention.

As illustrated in the flowchart of FIG. 3, the controller judges an occurrence of a jam during image formation when the transfer material is not on the transfer material presence or absence detecting sensor 11 before a resist after predetermined time T1 has passed and when the transfer material is not on the transfer material presence or absence detecting sensor 12 after fixing after predetermined time T3 has passed. The T1 and T3 are previously set depending on the length of the transfer material. Time it takes for the transfer material to reach the transfer material presence or absence detecting sensor 11 before a resist from the feed cassette and time it takes for the transfer material to reach the transfer material presence or absence detecting sensor 12 after fixing from the feed cassette can be previously found from the length of the transfer material. Therefore, an occurrence of a jam is judged by setting this time and by detecting that the transfer material is not on each of the sensors at the time. The time is counted by the time counting unit.

In a similar manner, an occurrence of a jam is judged also when the transfer material is on the transfer material presence or absence detecting sensor before a resist after predetermined time T2 has passed and when the transfer material is on the transfer material presence or absence detecting sensor 12 after fixing after predetermined time T4 has passed. The T2 and T4 are also previously set depending on the length of the transfer material. Similarly, time when the transfer material passes the transfer material presence or absence detecting sensor 11 before a resist and time when the transfer material passes the transfer material presence or absence detecting sensor 12 after fixing are previously found from the length of the transfer material. Accordingly, an occurrence of a jam is judged by detecting the presence of the transfer material at time when the transfer material is supposed to have passed the sensor.

When an occurrence of a jam is judged, the controller stops a driving unit and displays notification of the occurrence of the jam on the operating unit 13. As illustrated in the flowchart of FIG. 3, the controller receives a printing instruction and starts printing (S301). If paper is on the transfer material presence or absence detecting sensor 11 before a resist after T1 has passed (Yes at S302), a message "demount and mount feed cassette" is displayed on the operating unit 13 (S303) to urge the demounting and mounting the feed cassette for removing a jam.

If paper is on the transfer material presence or absence detecting sensor 11 before a resist after T2 has passed (Yes at S304), a message "open rear cover" is displayed on the operating unit 13 (S305) to urge the opening of the rear cover for removing a jam because the paper is expected to be jammed at the front of the transfer material presence or absence detecting sensor 11 before a resist. If no paper is on the transfer material presence or absence detecting sensor 12 after fixing after T3 has passed (Yes at S306), a message "open front cover" is displayed on the operating unit 13 (S308) to urge the opening of the front cover for removing a jam. If paper is on the transfer material presence or absence detecting sensor 12 after fixing after T4 has passed (Yes at S307), a message "open front cover" is displayed on the operating unit 13 (S308) to urge the opening of the front cover for removing a jam because the paper is expected to be jammed at the front of the transfer material presence or absence detecting sensor 12 after fixing. If paper is on the transfer material presence or absence detecting sensor 12 after fixing after T4 has passed (No at S307), the controller judges whether there is a subsequent waiting job (S309). If not (No at S309), the image forming apparatus enters a standby mode. If there is a subsequent waiting job (Yes at S309), the process returns to S301.

As described above, the instruction of moving the front cover to the opened position is displayed only when the trailing end of the transfer material passes through the resist roller. Accordingly, the transfer material is not pulled between the resist roller and the transfer belt as a result of driving the transfer belt by moving the front cover to the opened position when both the resist roller and the transfer belt are nipping the transfer material. This can prevent problems in which the transfer material is pulled and torn.

Figure 4:
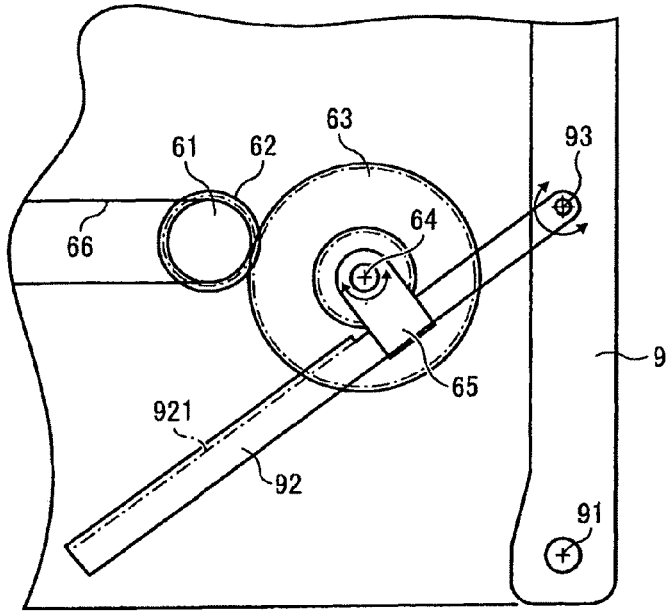
FIG. 4 is a schematic diagram for explaining an action of the image forming apparatus according to an embodiment of the present invention.

An embodiment of the present invention is described with reference to FIGS. 4 and 5. FIG. 4 illustrates a structure near a transfer driving roller 61 in the transfer unit 6 when a front cover 9 is at a closed position relative to the main body of the apparatus. A transfer driving gear 62 is provided at the end of the transfer driving roller 61 in the axial direction and is driven by a driving motor (not illustrated) through a gear (not illustrated). The transfer driving gear 62 is coupled to a reduction gear 63.

The front cover 9 is provided at the main body of the apparatus to be rotatable in the arrow C direction around a front cover rotation fulcrum 91. A rack member 92 is provided at the front cover 9 to be rotatable around a rack material rotation fulcrum 93. A gap member 65 provided to be rotatable around a reduction gear rotation fulcrum 64 holds the rack member 92 so that the distance between the rack member 92 and the reduction gear rotation fulcrum 64 is less than a predetermined value. The rack member 92 partially includes a gear portion 921, and when the front cover 9 is at a closed position relative to the main body of the apparatus, the gear portion 921 is not coupled to the reduction gear 63.

Figure 5:
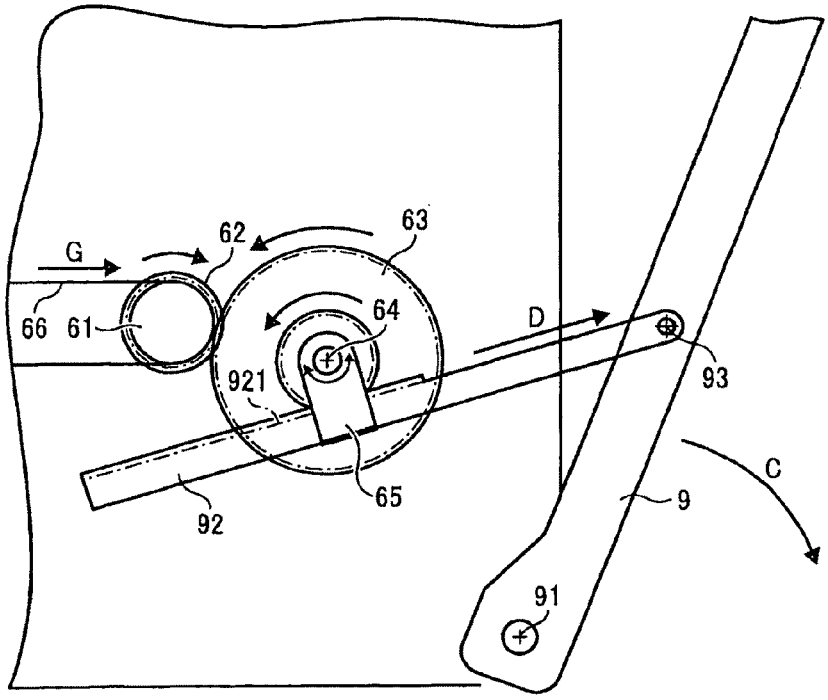
FIG. 5 is a schematic diagram for explaining an action of the image forming apparatus according to an embodiment of the present invention.

FIG. 5 illustrates a structure around the transfer driving roller 61 when the front cover 9 is opened to be positioned at the middle between the closed position and the opened position relative to the main body of the apparatus. When the front cover rotates in the arrow C direction, the rack member 92 is pulled in an arrow D direction while maintaining a constant distance from the reduction gear rotation fulcrum 64 with the gap member 65. Thus, the gear portion 921 of the rack member 92 is coupled to the reduction gear 63. If the front cover 9 is further opened in the arrow C direction, the reduction gear 63 rotates in an arrow E direction. Thus, the transfer driving gear 62 coupled to the reduction gear 63 rotates in an arrow F direction to drive a transfer belt 66 suspended in a tensioned state with the transfer driving roller 61 in an arrow G direction.

The driving unit that drives the conveying unit in conjunction with the action by which the front cover moves from the closed position to the opened position is provided as described above. Thus, when the transfer material is jammed in the apparatus, the transfer material is conveyed by moving the front cover to the opened position, which improves the visibility and operability of the transfer material during the removal of a jam. Accordingly, this can resolve the problem in which only a small portion of the transfer material can be pinched.

This structure includes only a rack member and gears and thus is low in cost and simple. When the rack member is coupled to the gears while the front cover is at the closed position relative to the main body of the image forming apparatus, the transfer belt cannot be driven during image formation. Therefore, when the front cover is at the closed position, the coupling needs to be detached.

Figure 6:
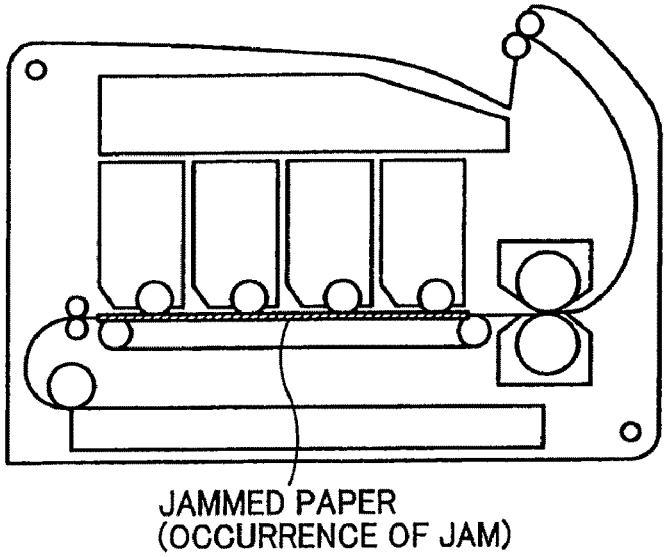
FIG. 6 is a schematic diagram for explaining an action of the image forming apparatus according to an embodiment of the present invention according to an embodiment of the present invention.
Figure 7:
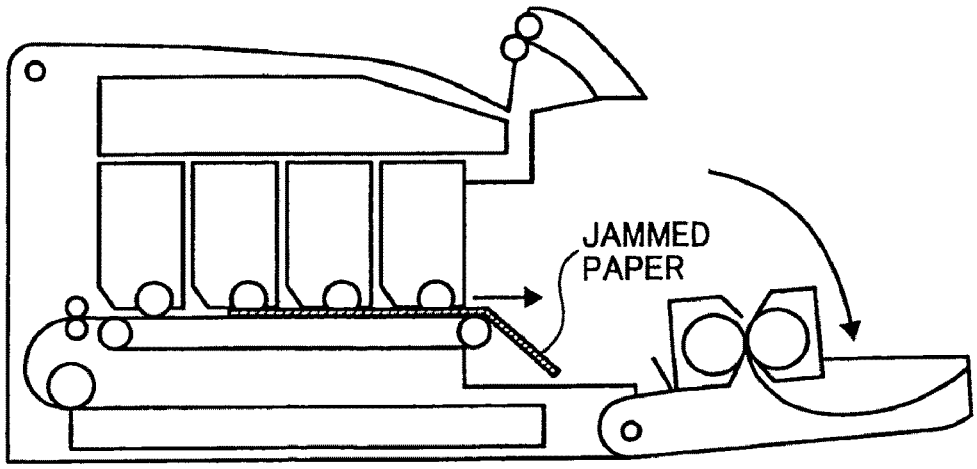
FIG. 7 is a schematic diagram for explaining an action of the image forming apparatus according to an embodiment of the present invention.

When a jam occurs in a state where the transfer material is positioned on the transfer belt as illustrated in FIG. 6, the front cover 9 is rotated in the arrow C direction to move the transfer belt 66 in the arrow G direction as explained in FIG. 5 to convey the transfer material toward the fixing unit. As illustrated in FIG. 7, when the cover moves to the opened position, the transfer material is exposed to the space created when the fixing unit 7 is opened, which enables users to readily remove the transfer material.

The reduction gear has a one-way structure and transmits power in the arrow F direction of FIG. 5 but do not transmit power in the reverse direction. Such a structure can prevent problems from occurring in the image forming process caused by the transfer belt 66 driven in the reverse direction of the arrow G along with the movement of the front cover 9 from the opened position to the closed position, and can reduce operating force for moving the front cover 9 to the closed position. While the reduction gear 63 has a one-way structure in the embodiment, the transfer driving gear 62 may also have a one-way structure. When an idler gear is coupled to the reduction gear 63, the idler gear may also have a one-way structure.

Figure 8:
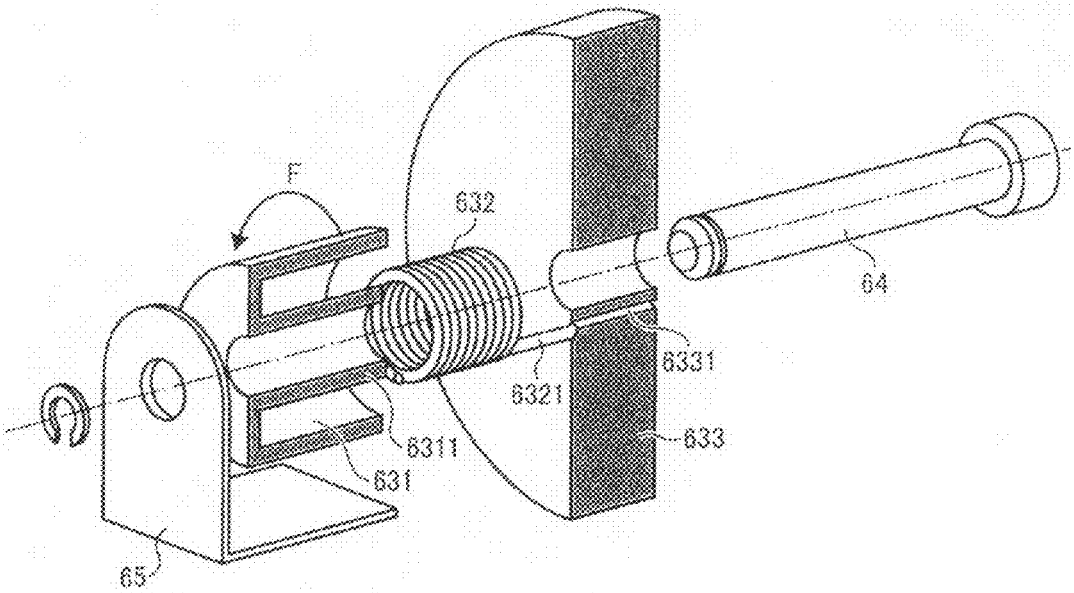
FIG. 8 is a schematic diagram of a structure of a gear illustrated in FIG. 4 of the image forming apparatus according to an embodiment of the present invention.

FIG. 8 is a schematic diagram for explaining a one-way structure of the reduction gear 63. The one-way structure of the reduction gear 63 is explained with reference to FIG. 8. The reduction gear 63 includes a small diameter gear 631, a coil spring 632, and a large diameter gear 633. An end 6321 of a coil spring is inserted into an insertion portion 6331 of the large diameter gear 633 that substantially fit the end 6321 of a coil spring, and thus, the large diameter gear 633 and the coil spring 632 integrally rotate around the reduction gear rotation fulcrum 64. The small diameter gear 631 has a press-insertion portion 6311 having a diameter larger than the inner diameter of the coil spring 632. The press-insertion portion 6311 is pressed in the coil spring 632, and thus the coil spring 632 tightens the press-insertion portion 6311 when the small diameter gear 631 is driven in the arrow F direction. As a result, the small diameter gear 631, the coil spring 632, and the large diameter gear 633 integrally rotate to transmit power. The coil spring 632 loosens when driven in the reverse direction of the arrow F. Therefore, the coil spring 632 and the large diameter gear 633 do not rotate and no power is transmitted. FIG. 8 is an example of the one-way structure and does not limit the embodiment of the present invention. Other structures can also have the same effect so long as the structures include one-way structures.

By transmitting power only in a direction for driving the transfer belt in a direction of being conveyed downstream (in a forward direction) as described above, the transfer unit can be prevented from being driven in the reverse direction while the front cover moves to the closed position. When the front cover moves to the opened position, power required for driving the conveying unit can also be used for a shock absorber during the opening of the front cover. Therefore, the structure does not need cushioning members to be low in cost. In addition, when the front cover moves to the closed position, the front cover can be moved with operating force smaller than that for moving the front cover to the opened position, and therefore, an image forming apparatus excellent in operability can be provided.

Figure 9:
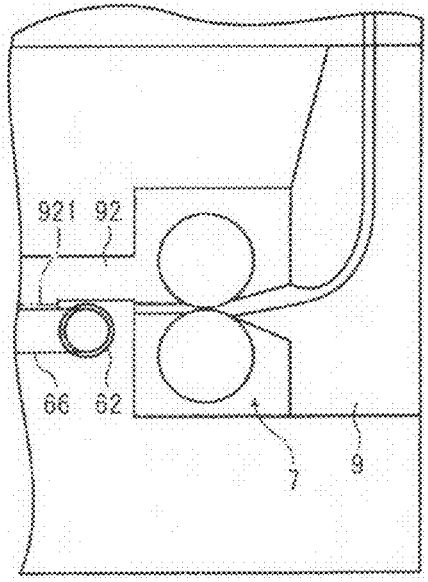
FIG. 9 is a schematic diagram for explaining an action of the image forming apparatus according to an embodiment of the present invention.
Figure 10:
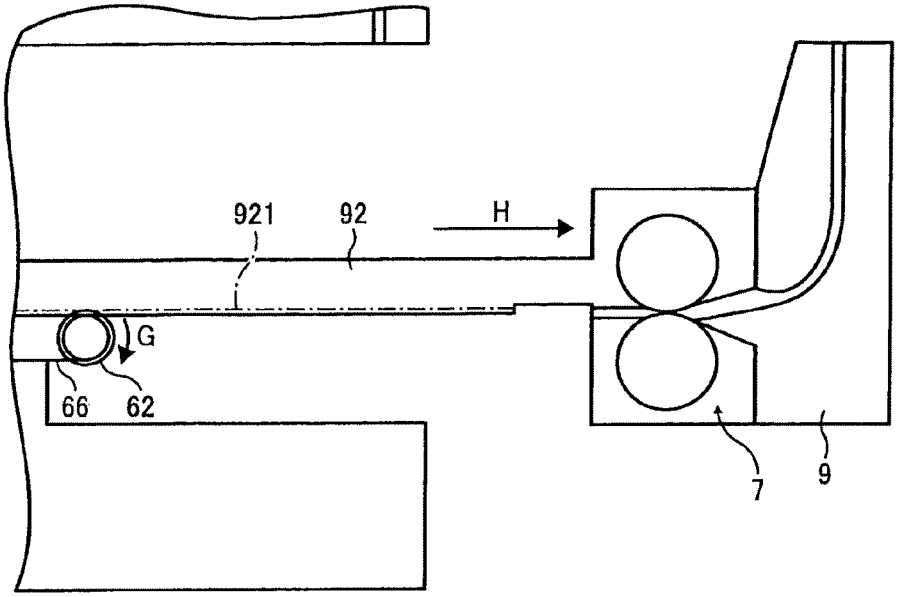
FIG. 10 is a schematic diagram for explaining an action of the image forming apparatus according to an embodiment of the present invention.

As illustrated in FIGS. 9 and 10, the transfer driving gear 62 may be rotated by integrally pulling out the fixing unit 7 and the front cover 9 in an arrow H direction as a method of rotating the transfer driving gear 62 by the opening and closing action of the front cover 9. When the front cover 9 is pulled out in the arrow H direction, the rack member 92 integrally included in the front cover 9 moves. The gear portion 921 of the rack member 92 is not coupled to the transfer driving gear 62 when the front cover is at the closed position but is coupled to the transfer driving gear 62 in the process of pulling out the front cover 9. During the process, the transfer belt 66 is driven in the arrow G direction, and the transfer material is exposed to the space created when the fixing unit 7 is opened, which enables users to readily remove the transfer material. The transfer driving gear 62 has a one-way structure as illustrated in FIG. 8 and does not rotate while the front cover 9 moves to the closed position. Such a structure can prevent problems from occurring in the image forming process caused by the transfer belt 66 driven in the reverse direction of the arrow G, and can reduce operating force for moving the front cover 9 to the closed position. An idler gear and a reduction gear may also be used at a position between the transfer driving gear 62 and the rack member 92, and the same effect can also be obtained when the idler gear and the reduction gear have one-way structures.

Figure 11:
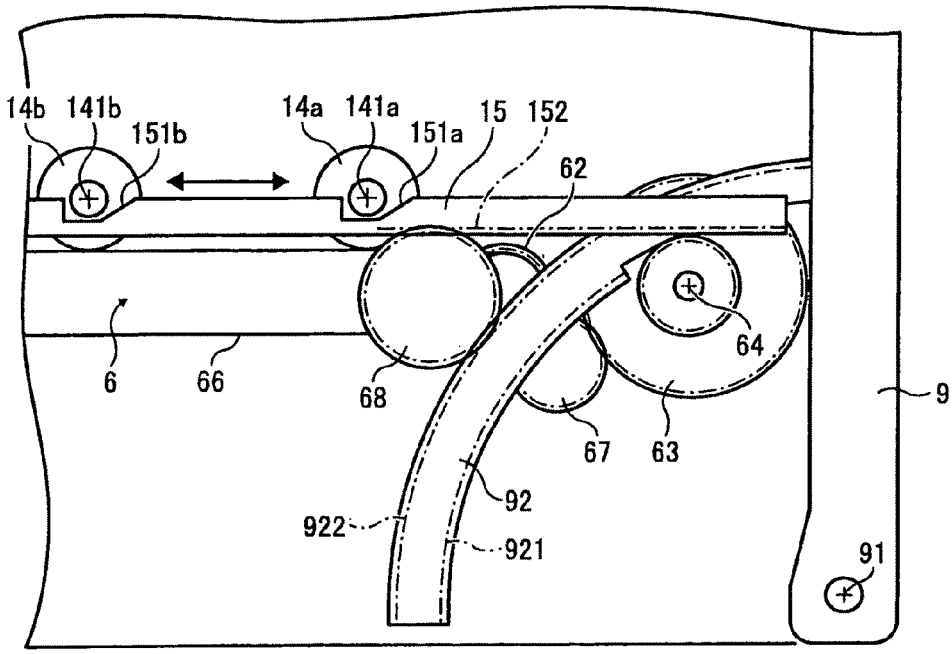
FIG. 11 is a schematic diagram for explaining an action of the image forming apparatus according to an embodiment of the present invention.

An embodiment of the present invention is described with reference to FIGS. 11 and 12. FIG. 11 is different from the embodiment illustrated in FIGS. 4 and 5 in that regarding the movement of the front cover 9 and the driving of the transfer belt 66, an idler gear 67 is added and the rack member 92 is formed in an arc shape around the front cover rotation fulcrum 91. Still, the structure in FIG. 11 has the same effect as with the embodiment illustrated in FIGS. 4 and 5. The structure of this embodiment further includes four inclined portions 151*a* to 151*d* that are movable in a direction substantially parallel to the main body of the apparatus and that correspond to rotation shafts 141*a* to 141*d*, respectively, for photosensitive bodies, a slide member 15 having a gear portion 152, and a second idler gear 68 coupled to the gear portion 152 of the slide member 15 and a second gear portion 922 of the rack member 92. The rotation shafts 141*a* to 141*d* for photosensitive bodies are held to be movable only in substantially upward and downward directions by U shaped positioning grooves of the main body frame (not illustrated) that substantially fit the rotation shafts 141*a* to 141*d* for photosensitive bodies. The rotation shafts 141*a* to 141*d* for photosensitive bodies are not in contact with the slide member 15 in a state where the front cover 9 is at the closed position. Therefore, when the front cover 9 is at the closed position, the rotation shafts 141*a* to 141*d* for photosensitive bodies are accurately positioned by the weight of a developing unit 1 itself along the positioning grooves of the main body frame (not illustrated).

Figure 12:
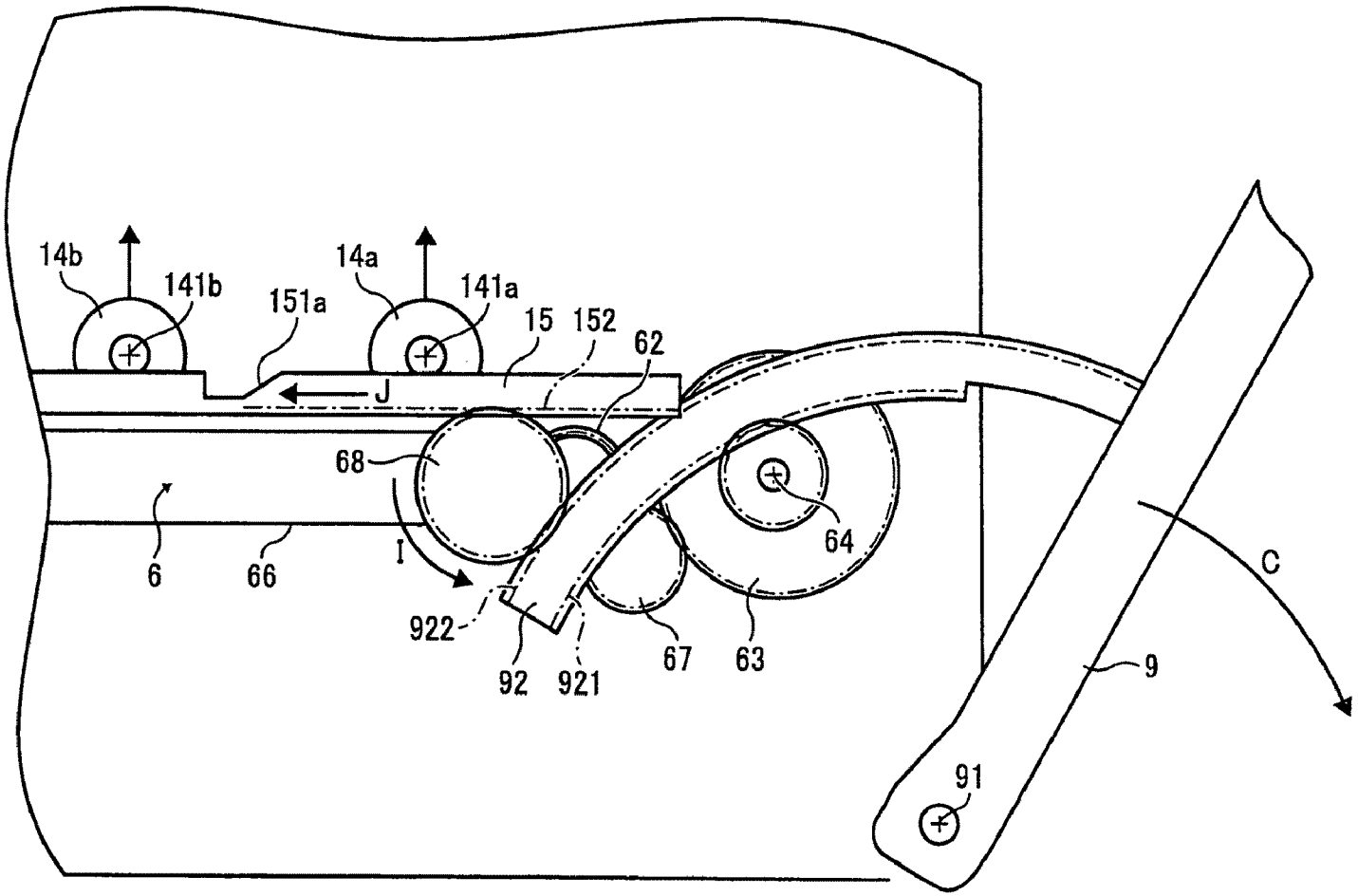
FIG. 12 is a schematic diagram for explaining an action of the image forming apparatus according to an embodiment of the present invention.

As illustrated in FIG. 12, when the front cover 9 is opened in the arrow C direction, the second idler gear 68 rotates in a direction indicated by an arrow I, and the slide member coupled to the gear slides in an arrow J direction. The inclined portions 151*a* to 151*d* substantially upwardly lift the rotation shafts 141*a* to 141*d* for photosensitive bodies held to be movable only in substantially upward and downward directions, and then photosensitive bodies 14*a* to 14*d* are separated from the transfer unit 6. The photosensitive bodies 14*a* to 14*d* can be separated from the transfer unit 6 before the transfer belt 66 starts to be driven because the second idler gear 68 is always coupled to the second gear portion 922 of the rack member 92. As a result, the photosensitive bodies 14*a* to 14*d* and the transfer belt 66 can be prevented from getting dirty with unfixed toner and being scratched due to the friction between the photosensitive bodies 14*a* to 14*d* and the transfer material or between the photosensitive bodies 14*a* to 14*d* and the transfer belt 66.

Such a structure enables the transfer material not to be caught between the photosensitive bodies and the transfer belt, and thus, the transfer belt can be pulled out with little force.

Driving the transfer belt after the transfer belt and the photosensitive bodies are separated can prevent the photosensitive bodies from being scratched by being rubbed against the transfer material adsorbed and transported on the transfer belt. The complexity of the structure and the increase in the size due to the structure in which the movement of the front cover drives the image carriers can also be avoided. Moreover, the photosensitive bodies are lifted with bar members, and thus, a simple structure is achieved at low cost.

In an image forming apparatus including a transfer unit that transfers a toner image to a transfer material below an image forming unit, when a jam occurring near the transfer unit is removed, the following methods are possible for removing the transfer material. A method of taking off a component that nips the transfer material, for example, the image forming unit, from the main body of the apparatus to take out the transfer material or a method of taking off the fixing unit to take out the transfer material attached to the fixing unit.

By the former method, the number of actions increases because (one to four) image forming units need to be removed after the top cover is opened. Moreover, large operating force is required for integrally opening the top cover and the image forming units, and furthermore, large-scale cushioning members are required for shock absorption for the opening and the closing action.

By the latter method, the number of actions increases because the nipping by the fixing unit needs to be released for removing the transfer material attached to the fixing unit, and when the transfer material is not nipped by the fixing unit, the transfer material cannot be taken out from the apparatus.

However, even in such an image forming apparatus, when the apparatus includes the driving unit that drives the transfer belt in conjunction with the opening and closing action of the front cover, the transfer material can be readily removed by moving the front cover to the opened position to expose the transfer material in the apparatus. In other words, the transfer material can be removed without requiring a large-scale cushioning member and increasing the number of actions, and thus a small image forming apparatus excellent in maintainability can be provided.

Figure 13:
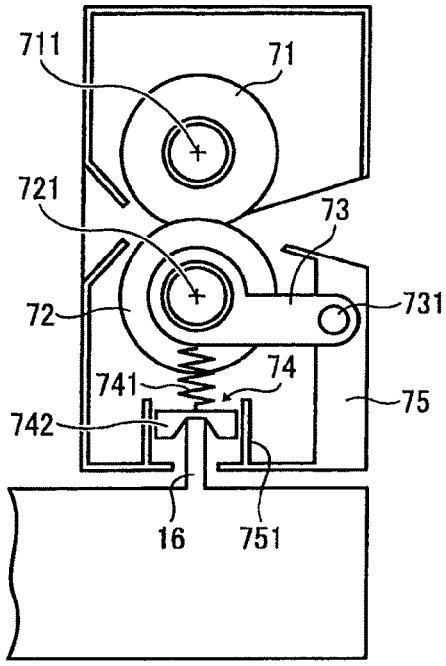
FIG. 13 is a schematic diagram for explaining an action of a fixing unit illustrated in FIG. 1 of the image forming apparatus according to an embodiment of the present invention.
Figure 14:
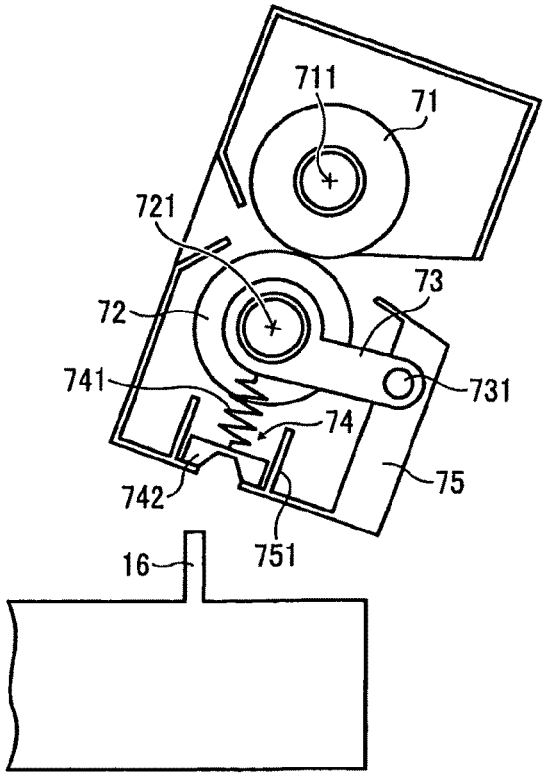
FIG. 14 is a schematic diagram for explaining an action of the fixing unit of the image forming apparatus according to an embodiment of the present invention.

FIG. 13 is a schematic diagram of the fixing unit 7 of the image forming apparatus according to an embodiment of the present invention. The fixing unit 7 includes a heating roller 71 rotatably held around a rotation fulcrum 711, a pressurizing roller 72, a pressurizing roller holding member 73 that holds both ends of the pressurizing roller 72 in the shaft direction to be rotatable around a rotation fulcrum 721 and is rotatable around a rotation shaft 731, a pressure roller biasing member 74 that biases the pressurizing roller 72 substantially upwardly, a fixing cover 75, and similar components. The pressure roller biasing member 74 includes a spring member 741 and a slide member 742 slidable in substantially upward and downward directions along a guiding portion 751 provided at the lower position of the fixing cover 75. When the front cover 9 is at the closed position, a protruding portion 16 provided at the main body of the apparatus is inserted into the guiding portion 751 to press the pressure roller biasing member 74 substantially upwardly, and thus, the pressurizing roller 72 makes contact with and presses the heating roller 71 to form a nip. As illustrated in FIG. 14, when the front cover 9 moves to the opened position, the pressure roller biasing member 74 slides to the bottom of the fixing unit 7 to release the nip between the pressurizing roller 72 and the heating roller 71.

Figure 15:
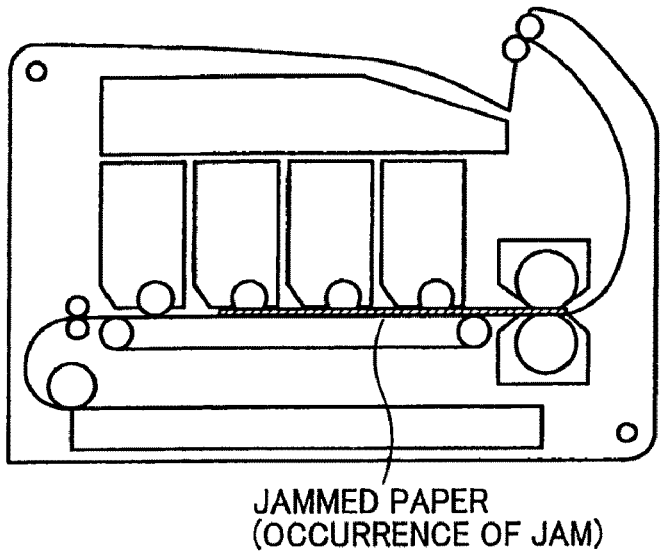
FIG. 15 is a schematic diagram for explaining an action of the image forming apparatus according to an embodiment of the present invention.
Figure 16:
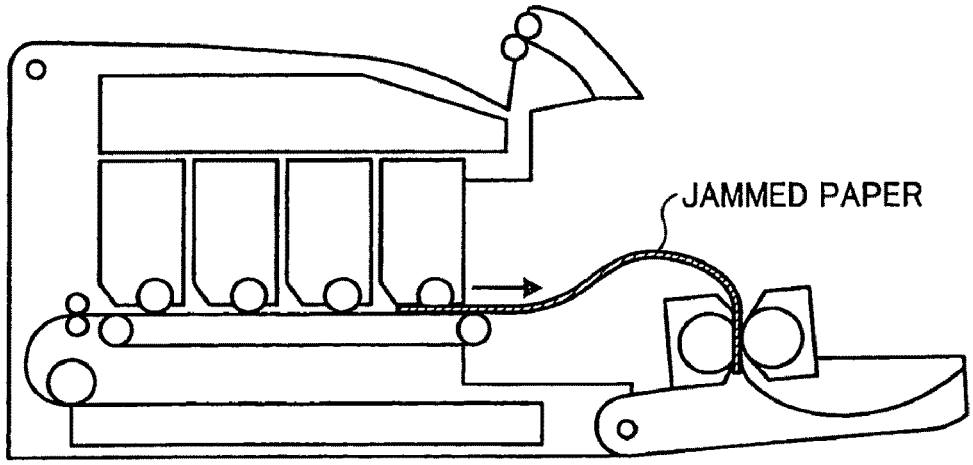
FIG. 16 is a schematic diagram for explaining an action of the image forming apparatus according to an embodiment of the present invention.

With such a structure, for example, even when a jam occurs in a state where the transfer material is nipped by both the transfer unit 6 and the fixing unit 7 as illustrated in FIG. 15, the transfer material can be removed by simply opening the front cover 9 without the action of releasing the nip in the fixing unit 7 as illustrated in FIG. 16. The embodiment described here is one example. The same effects can be obtained with the following structures. For example, a structure in which the pressure roller biasing member 74 protrudes from the guiding portion 751 of the fixing cover 75, the protruding portion of the biasing member makes contact with the main body of the apparatus and forms a nip when the front cover 9 is at the closed position, and the nip is released when the front cover 9 is at the opened position and a structure in which an holding member movably holds the heating roller 71.

As described above, the biasing unit biases the heating roller or the pressurizing roller only when the front cover is at the closed position. As a result, when a jam occurs in a state where the transfer material is nipped by the fixing unit, the action of releasing the connection through pressure between the heating roller and the pressurizing roller after the front cover moves to the opened position becomes unnecessary, and therefore, an image forming apparatus excellent in operability can be provided.

The front cover integrally movably includes the fixing unit, and thus, when the front cover moves to the opened position, the fixing unit is opened to create a large processing space for the removal of a jam is formed. Therefore, an image forming apparatus excellent in operability can be provided.

A primary harness for the fixing unit is connected with the main body of the apparatus to pass around the fulcrum shaft of the front cover. For a structure in which the front cover can move, besides rotate, relative to the main body of the apparatus (for example, a pull-out system), a long harness capable of electrically connecting the fixing unit with the main body of the apparatus even when the front cover moves to the opened position needs to be used, or the opening and closing member needs to be connected using a detachable connector. The former method has disadvantages that a space is needed for housing the harness when the opening and closing member is at the closed position relative to the main body of the apparatus, and that an expensive harness needs to be used because of its long length. The latter method accompanies the mounting and demounting the connector for moving the opening and closing member and thus requires large operating force, which degrades the operability. Therefore, the front cover is formed to be rotatable relative to the main body of the apparatus, and an electrically connecting unit (harness) is provided to pass around the rotation fulcrum. Accordingly, the connecting unit can be short and low in cost, and the connector becomes unnecessary, which enables an image forming apparatus to be provided at low cost and with excellent operability.

A gear ratio is set so that the conveyance amount of the transfer material conveyed by the rotation when the front cover 9 is opened is longer than a difference between the distance from the resist roller 5 to the fixing unit 7 and the length of paper. With this gear ratio, even when a jam occurs at the position immediately after the trailing end of the transfer material passes through the resist roller 5, the leading end of the transfer material can be conveyed close to the fixing unit 7 by opening the front cover 9, which can improve the visibility of the jammed paper and operability. As indicated in Table 1, in the present embodiment, when the front cover 9 is opened, the rotation of the transfer driving roller is amplified so as to rotate about 16.8 times the rotation angle of the front cover 9. Once the front cover 9 is opened, the transfer belt 66 can be conveyed about 210 millimeters that is longer than 173 millimeters obtained by subtracting the length of the minimum transfer material from the distance from the resist roller 5 to the fixing unit 7.

When a jam occurs at a position immediately after the minimum transfer material applicable to the image forming apparatus, for example, a postcard (a length of 127 millimeters) passes the resist roller, the transfer material is sent to the fixing roller where the transfer material can be easily held by one opening action. For this operation, the transfer material needs to be conveyed 123 millimeters when the conveying distance from the resist roller to the fixing roller is 250 millimeters (for the image forming apparatus employing a direct transfer system as described above, about 300 or more millimeters). 123 millimeters is a value corresponding to the conveying distance when the transfer driving roller having ϕ18 rotates 2.2 times. Assuming that the largest open angle of the front cover is 80 degrees (0.22 rotation), with the transfer unit driven in rotation by a rotation angle amplified 10 or more times that of the opening and closing member, the transfer material can be conveyed close to the fixing roller by one opening action. Thus, an image forming apparatus excellent in operability for removing a jam can be provided.

TABLE 1

| | | |
|---|---|---|
| (1) | Distance from resist roller 5 to fixing unit 7 | 300 mm |
| (2) | Length of applicable minimum paper | 127 mm |
| (3) | (1) − (2) | 173 mm |
| (4) | Pitch circle diameter of rack gear portion | 140 mm |
| (5) | Angle of rack gear portion | 60° |
| (6) | Pitch circle diameter of reduction gear (small diameter) | Φ 20 mm |
| (7) | Pitch circle diameter of reduction gear (large diameter) | Φ 48 mm |
| (8) | Pitch circle diameter of transfer driving gear 62 | Φ 20 mm |
| (9) | Rack: amplification of transfer driving gear | 16.8 times |
| (10) | Driving amount of transfer belt 66 | 210 mm |

Figure 17:
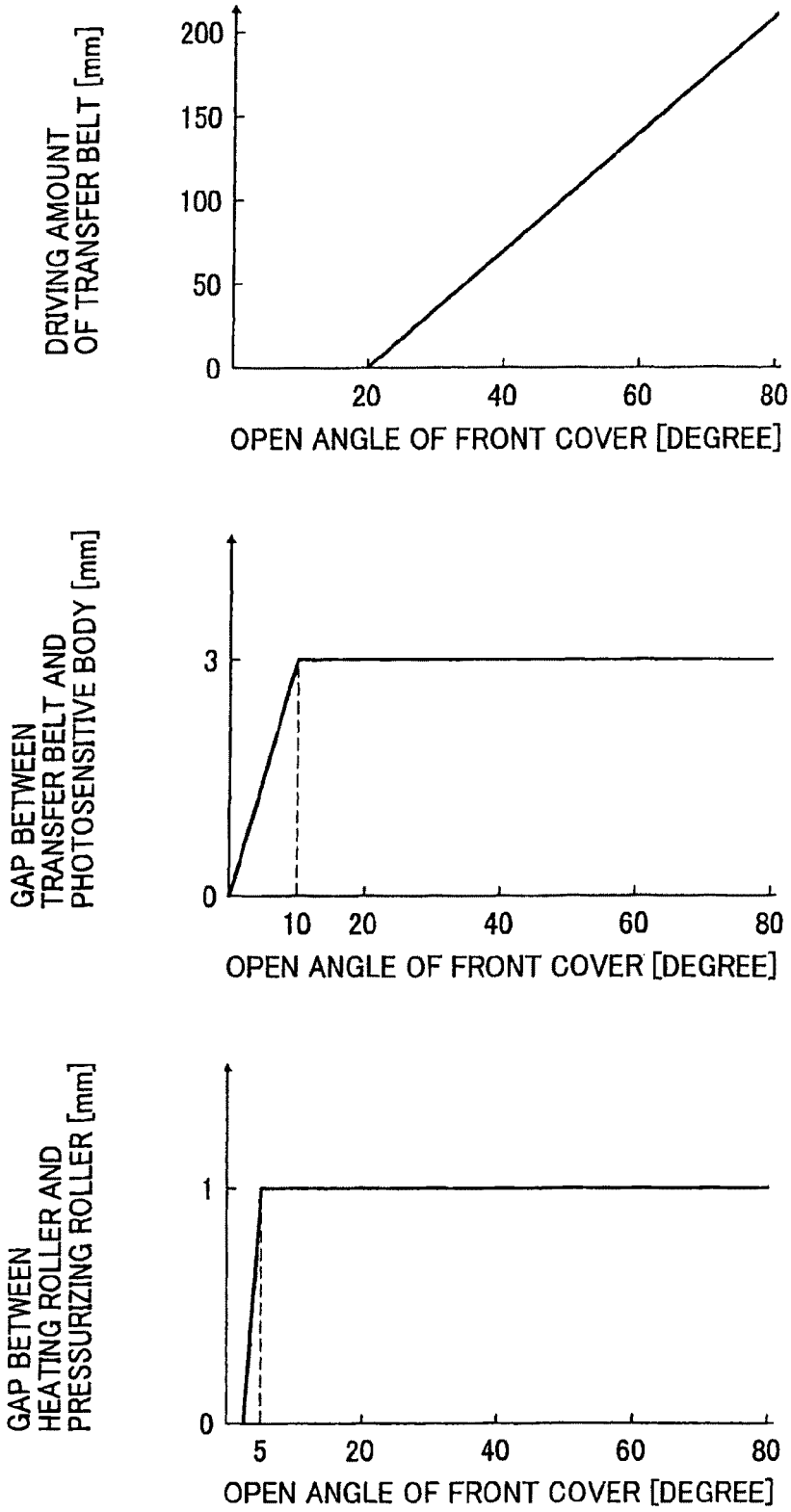
FIG. 17 is graphs for illustrating relationships between the open angle of a front cover illustrated in FIG. 1 and the driving amount of a transfer belt illustrated in FIG. 4, a gap between the transfer belt and photosensitive bodies illustrated in FIG. 11, and a gap between a heating roller and a pressurizing roller both of which are illustrated in FIG. 13, in the image forming apparatus according to an embodiment of the present invention.

FIG. 17 is graphs illustrating each of the relationships between the open angle of the front cover 9 and the driving amount of the transfer belt 66, distance between the transfer belt 66 and the photosensitive bodies 14*a* to 14*d*, and distance between the heating roller 71 and the pressurizing roller 72 both of which are in the fixing unit. When the front cover 9 starts to be opened, the rack member 92 and the reduction gear 63 are coupled at the point where the front cover 9 is opened at 20°, and the transfer belt 66 starts to be driven. Subsequently, the driving amount increases in proportion to the rotation angle, and when the front cover 9 is opened at 80°, the transfer belt 66 is conveyed 210 millimeters. The distance between the transfer belt 66 and the photosensitive bodies 14*a* to 14*d* increases in proportion to the open angle when the front cover 9 is opened from 0° to 10°. This is because the rotation shafts 141*a* to 141*d* for photosensitive bodies are gradually lifted with the inclined portions 151*a* to 151*d* of the slide member 15. With the opening angle larger than 10°, the horizontal portion of the slide member 15 supports the rotation shafts 141*a* to 141*d* for photosensitive bodies, and therefore, the distance becomes constant. The gap between the heating roller 71 and the pressurizing roller 72 both of which are in the fixing unit 7 stays at 0 regardless of the open angle until the open angle reaches about 3°. This is because although the distance between the shafts increases in correspondence with the opening of the front cover 9, a nip is formed when the front cover 9 is at the closed position. The gap increases in proportion to the open angle from 3° to 5° and then becomes substantially constant. These graphs reveal that when the front cover 9 is opened, the transfer belt 66 starts to be driven after the transfer belt 66 and the photosensitive bodies 14*a* to 14*d* are separated, and the gap between the heating roller 71 and the pressurizing roller 72 is formed.

Figure 18:
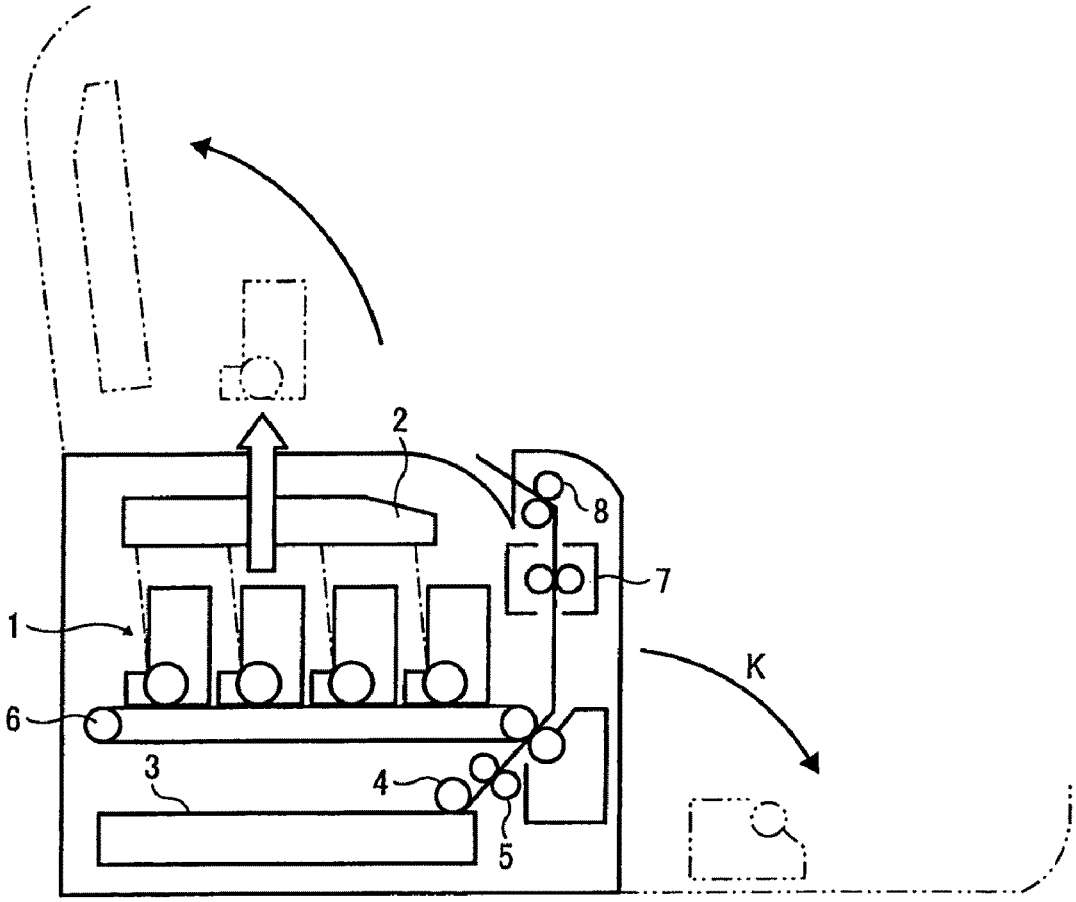
FIG. 18 is a schematic diagram for explaining an action of the image forming apparatus according to an embodiment of the present invention.
Figure 19:
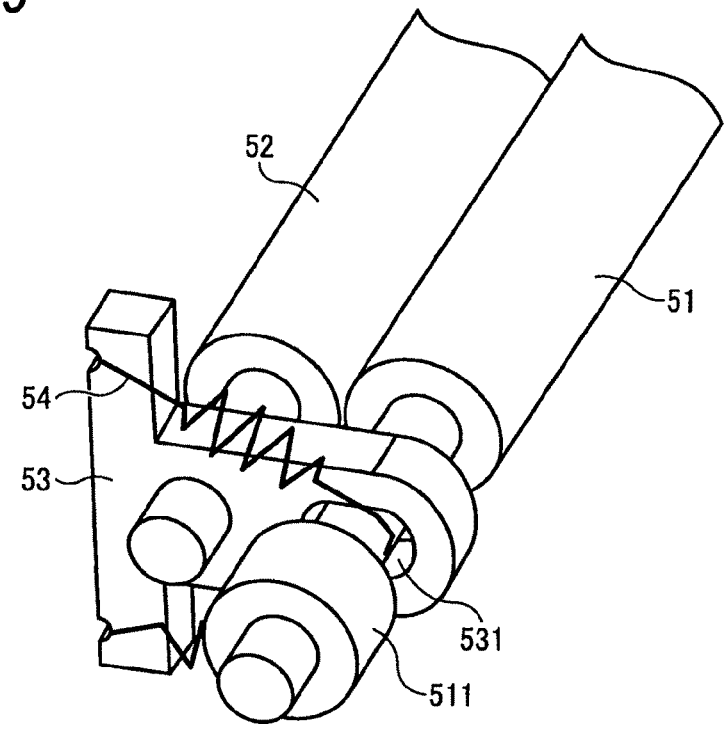
FIG. 19 is a schematic diagram of a structure of resist rollers illustrated in FIG. 1 of the image forming apparatus according to an embodiment of the present invention.
Figure 20:
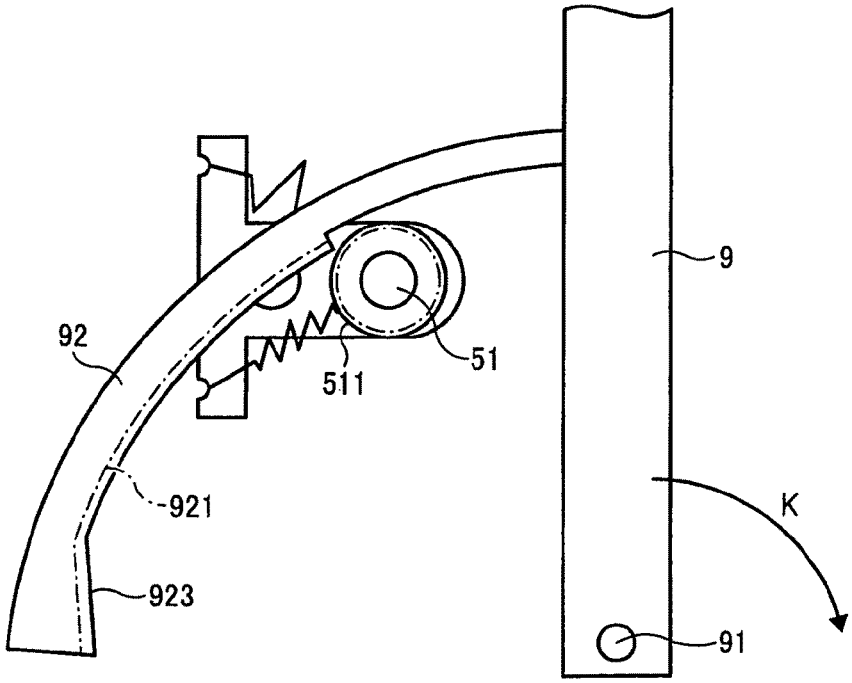
FIG. 20 is a schematic diagram for explaining an action of the image forming apparatus according to an embodiment of the present invention.

An embodiment of the present invention is described with reference to FIGS. 18 to 20. In the present embodiment, the resist roller 5 is driven in conjunction with the opening and closing of the front cover 9. The resist roller 5 includes a resist driving roller 51 and a resist driven roller 52. Both ends of the resist driving roller 51 and the resist driven roller 52 are held by a bearing 53 having a slot portion 531, and the resist driving roller 51 makes contact with and presses the resist driven roller 52 using a spring member 54. The resist driving roller 51 and the resist driven roller 52 are coupled through a gear (not illustrated). As illustrated in FIG. 20, the rack member 92 includes an inclined portion 923. When the front cover 9 rotates in an arrow K direction, a gear portion 511 in the resist driving roller 51 is coupled to the gear portion 921 of the rack member 92 to rotate the resist driving roller 51 and the resist driven roller 52. When the front cover 9 is further opened in the arrow K direction, the resist driving roller 51 and the resist driven roller 52 are separated with the inclined portion 923. During the removal of a jam, the transfer material is conveyed by the rotation of the resist driving roller 51 and the resist driven roller 52 to improve the visibility of paper and can be pulled out with small operating force due to the separation of the rollers.

The present invention is described above according to exemplary embodiments of the present invention. Although the present invention is described with reference to specific examples, various changes and modifications can be made to the specific examples without departing from the spirit and scope of the present invention as set forth in the appended claims.

The image forming apparatus of the present invention may include two rotation rollers of a first rotation roller that suspends the transfer belt in a tensioned state and a second rotation roller, a rack member attached to the front cover, a first gear attached to the first rotation roller, a second gear coupled to the first gear, and a third gear that is attached to the rack member and is coupled to the second gear. The transfer belt may move in the following manner. The opening action of the front cover moves the rack member, the movement of the rack member moves the third gear, the movement of the third gear rotates the second gear, the rotation of the second gear rotates the first gear, the rotation of the first gear rotates the first rotation roller, and the rotation of the first rotation roller moves the transfer belt.

In the image forming apparatus of the present invention, at least one of the two gears of the first gear and the second gear may be a one-way gear.

In the image forming apparatus of the present invention, the transfer belt may be driven in conjunction with the opening action of the front cover after the photosensitive bodies are separated from the transfer belt in conjunction with the opening action of the front cover.

The image forming apparatus of the present invention may also include a slide member having inclined portions and a fourth gear that is attached to the slide member and is coupled to the third gear. The transfer belt may also be separated from the photosensitive bodies in the following manner. The opening action of the front cover moves the rack member, the movement of the rack member moves the third gear, the movement of the third gear moves the fourth gear, the movement of the fourth gear moves the slide member, the slide member lifts the photosensitive bodies with the inclined portions when the slide member is moved by the movement of the fourth gear, and the transfer belt is separated from the photosensitive bodies.

In the image forming apparatus of the present invention, the toner images may be transferred from the photosensitive bodies to the transfer material when the transfer material is positioned below the photosensitive bodies.

Moreover, in the image forming apparatus of the present invention, a gear ratio between the first gear and the second gear and a gear ratio between the second gear and the third gear may be a combination with which the movement distance of the transfer belt is 10 or more times the movement distance of the rack member.

The image forming apparatus of the present invention may also include a fixing unit that fixes a toner image transferred to the transfer material on the transfer material, and the fixing unit may move integrally with the front cover.

In the image forming apparatus of the present invention, the fixing unit may include a rotatable heating member, a pressurizing member that rotates while making contact with and pressing the heating member, and a biasing member that makes the heating member and the pressurizing member be in contact with each other with pressure by biasing one of the heating member and the pressurizing member. The biasing member may bias one of the heating member and the pressurizing member only when the front cover is in a closed state.

The image forming apparatus of the present invention may also include a sensor that detects whether the transfer material is present upstream of the transfer belt, a time counting unit that counts time, and a displaying unit that displays a message for users. The image forming apparatus may use the time counted by the time counting unit and judge the occurrence of a paper jam when the transfer material does not pass the sensor at a time when the transfer material is supposed to pass the sensor and when the transfer material passes the sensor at a time when the transfer material is not supposed to pass the sensor. In response to the judgment, the displaying unit may display a message that prompts a user to open the front cover.

Moreover, in the image forming apparatus of the present invention, the front cover may be rotatably connected around at least one fulcrum and be connected with the fixing unit through a linear electrically connecting unit that passes around the fulcrum.

In one aspect, the present invention can provide an image forming apparatus excellent in the visibility of jammed paper and operability for removing the jammed paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a transfer belt that conveys a transfer material;

a photosensitive body that catches the transfer material between the photosensitive body and the transfer belt and transfers a toner image to the transfer material, wherein the transfer belt is driven in conjunction with an opening action of a front cover, and the photosensitive body is separated from the transfer belt in conjunction with the opening action of the front cover;

a first gear and a second gear; and a first rotation roller that suspends the transfer belt in a tensioned state and a second rotation roller, wherein the first gear is attached to the first rotation roller, the second gear is coupled to the first gear, wherein the opening action of the front cover causes the rotation of the second gear which rotates the first gear, the rotation of the first gear then rotates the first rotation roller, and the rotation of the first rotation roller then moves the transfer belt, and wherein at least one of the first gear and the second gear is a one-way gear.

2. The image forming apparatus according to claim 1, further comprising:

a rack member attached to the front cover; and a third gear that is attached to the rack member and is coupled to the second gear, wherein the opening action of the front cover moves the rack member, the movement of the rack member moves the third gear, and the movement of the third gear rotates the second gear.

3. The image forming apparatus according to claim 2, further comprising:

a slide member that has an inclined portion; and a fourth gear that is attached to the slide member and is coupled to the third gear, wherein the opening action of the front cover moves the rack member, the movement of the rack member moves the third gear, the movement of the third gear moves the fourth gear, the movement of the fourth gear moves the slide member, the slide member lifts the photosensitive body by means of the inclined portion when the slide member is moved by the movement of the fourth gear to separate the photosensitive body from the transfer belt.

4. The image forming apparatus according to claim 2, wherein a gear ratio between the first gear and the second gear and a gear ratio between the second gear and the third gear are a combination with which movement distance of the transfer belt is 10 or more times movement distance of the rack member.

5. The image forming apparatus according to claim 1, wherein the transfer belt is driven in conjunction with the opening action of the front cover after the photosensitive body is separated from the transfer belt in conjunction with the opening action of the front cover.

6. The image forming apparatus according to claim 1, wherein the toner image is transferred from the photosensitive body to the transfer material when the transfer material is positioned below the photosensitive body.

7. The image forming apparatus according to claim 1, further comprising a fixing unit that fixes the toner image transferred to the transfer material on the transfer material, wherein the fixing unit moves integrally with the front cover.

8. The image forming apparatus according to claim 7, wherein the fixing unit comprises a rotatable heating member, a pressurizing member that rotates while making contact with and pressing the heating member, and a biasing member that makes the heating member and the pressurizing member be in contact with each other with pressure by biasing one of the heating member and the pressurizing member, and the biasing member biases one of the heating member and the pressurizing member only when the front cover is in a closed state.

9. The image forming apparatus according to claim 7, wherein the front cover is rotatably connected around at least one fulcrum and is connected with the fixing unit through a linear electrically connecting unit that passes around the fulcrum.

10. The image forming apparatus according to claim 1, further comprising: a sensor that detects whether the transfer material is present upstream of the transfer belt; a time counting unit that counts time; and a displaying unit that displays a message for a user, wherein the image forming apparatus uses time counted by the time counting unit and judges occurrence of a paper jam when the transfer material does not pass the sensor at a time when the transfer material is supposed to pass the sensor and when the transfer material passes the sensor at a time when the transfer material is not supposed to pass the sensor, and the displaying unit displays a message that prompts a user to open the front cover.

11. An image forming apparatus, comprising:

a transfer belt that conveys a transfer material;

a photosensitive body that catches the transfer material between the photosensitive body and the transfer belt and transfers a toner image to the transfer material, wherein the transfer belt is driven in conjunction with an opening action of a front cover, and the photosensitive body is separated from the transfer belt in conjunction with the opening action of the front cover; and a fixing unit that fixes the toner image transferred to the transfer material on the transfer material, wherein the fixing unit moves integrally with the front cover, wherein the fixing unit includes:

a rotatable heating member, a pressurizing member that rotates while making contact with and pressing the heating member, and a biasing member that makes the heating member and the pressurizing member be in contact with each other with pressure by biasing one of the heating member and the pressurizing member, wherein the biasing member biases one of the heating member and the pressurizing member only when the front cover is in a closed state.

12. An image forming apparatus, comprising:

a transfer belt that conveys a transfer material;

a photosensitive body that catches the transfer material between the photosensitive body and the transfer belt and transfers a toner image to the transfer material, wherein the transfer belt is driven in conjunction with an opening action of a front cover, and the photosensitive body is separated from the transfer belt in conjunction with the opening action of the front cover; and a fixing unit that fixes the toner image transferred to the transfer material on the transfer material, wherein the fixing unit moves integrally with the front cover, and wherein the front cover is rotatably connected around at least one fulcrum and is connected with the fixing unit through a linear electrically connecting unit that passes around the fulcrum.

* * * * *